US005271207A

United States Patent [19]

Epstein et al.

[11] Patent Number: 5,271,207

[45] Date of Patent: Dec. 21, 1993

[54] DUAL-FUNCTION NOZZLE HEAD FOR VACUUM-PACKAGING TOOLING

[75] Inventors: Moshe Epstein, 2530 Queensway, Northbrook, Ill. 60062; Robert D. Tischer, Oak Forest; Lilac Epstein, Northbrook, both of Ill.

[73] Assignee: Moshe Epstein, Northbrook, Ill.

[21] Appl. No.: 978,126

[22] Filed: Nov. 18, 1992

[51] Int. Cl.[5] ..... B65B 31/02

[52] U.S. Cl. ..... 53/432; 53/403; 53/510

[58] Field of Search ..... 53/432, 433, 403, 510, 53/511, 408, 478, 487, 485

[56] References Cited

U.S. PATENT DOCUMENTS

| | | | |
|---|---|---|---|
| 3,744,210 | 7/1973 | O'Lenick et al. | 53/433 |
| 4,294,859 | 10/1981 | Lundquist et al. | 53/433 X |
| 4,409,252 | 10/1983 | Buschkens et al. | 53/432 X |
| 4,624,099 | 11/1986 | Harder | 53/432 |
| 4,685,274 | 8/1987 | Garwood | 53/433 |

OTHER PUBLICATIONS

"Tiromat 3000" vacuum-packaging machine product—literature publication; T. W. Kutter, Avon, Mass.

*Primary Examiner*—James F. Coan

*Attorney, Agent, or Firm*—Milton S. Gerstein; Marvin Benn

[57] ABSTRACT

A dual-section nozzle-head for use in a vacuum-packaging machine. The first section of the nozzle-head is provided with an interiorly-located manifold, that fluidly connects a series of first orifices, the exit-ends of which are located at the tip of the nozzle-head, so that these orifices may be fluidly coupled to the interior of packages at a sealing station of a vacuum-packaging machine for evacuating the packages via a vacuum source to which the orifices are connected. Interspersed between these first orifices are second orifices, which also have their exit-mouths at the tip of the nozzle-head. The second orifices are spaced apart, one from the other, along the length of the nozzle-head, and are coupled to a second manifold that is positioned exteriorly of the housing of the nozzle-head. The second manifold is coupled to a supply of protective inert gas.

22 Claims, 5 Drawing Sheets

DUAL-FUNCTION NOZZLE HEAD FOR VACUUM-PACKAGING TOOLING

BACKGROUND OF THE INVENTION

The present invention is directed to a vacuum-packaging machine in which are produced sealed vacuum-packages of food, such as cold cuts, hot dogs, cheese, and the like. The conventional vacuum-package machine transports a bottom film-layer, which bottom film-layer has been formed into a series of pockets in which has been placed the food-product, to a sealing station, at which sealing station an upper film-layer is placed over, and sealed to, the bottom film-layer, whereby there are formed packages. The packages are evacuated at the sealing station, in order to form a vacuum-package. In the conventional vacuum-package machine, at the sealing station, there are provided an upper tool and a lower tool. The upper tool holds the upper film-layer by suction, while the lower tool holds down the bottom, film-layer, during evacuation and during the sealing process. Also provided at the sealing station, between the upper and lower tools is a nozzle-bar, or head, which is used for evacuating the packages. The nozzle-head extends the full width of the machine, and is coupled to a vacuum-source. The nozzle-head is activated until the packages at the sealing station have been evacuated, and then the packages are sealed completely about their edges.

The conventional vacuum-packaging machine is also often used to inject a protective gas into the packages, for extending shelf-life, which process is called gas-flashing. The gas used may be nitrogen or $CO_2$, or mixtures thereof. Gas-flashing also helps to ensure that individual slices of the meat or cheese in the package to do not stick together, and to make the package appear more full of product. In the conventional vacuum-packaging machine, the gas-flashing is accomplished with the same nozzle-head used for evacuating the packages. In the conventional vacuum-packaging machine, just before the package is sealed adjacent the nozzle-head, the a protective gas is injected into the packages, after which the sealing of the packages occurs.

A problem associated with gas-flashing as it is conventionally done, is that, when the nozzle-head is used to evacuate the packages, it draws out of the packages some particles of food. These particles of food, therefore, accumulate in the nozzle-head, or in the connecting hose therefor. These food particles, no matter how minute, form bacteria in the nozzle-head and connecting hose. Thus, when the very same nozzle-head is used to inject the protective gas into the packages via the very same path, these particles of food with bacteria are forced back into the packages. The bacteria adversely affect the shelf-life of the product in the packages, by causing the product to spoil prematurely, which at least partially defeats the very intent of the gas-flashing process.

The present invention overcomes this problem of re-injecting the bacteria-tainted food particles into the packages.

SUMMARY OF THE INVENTION

It is the primary objective of the present invention to provide a nozzle-head for a conventional vacuum-packaging machine which has two, separate and distinct sections: A first section for evacuating the packages, and a second section for injecting the protective gas into the packages.

It is another objective of the present invention to provide the two separate and distinct sections in the nozzle-head, such that the two sections are fluidly isolated from each other, in order to prevent the re-injection of bacteria-tainted food particles into the packages during gas-flashing.

It is yet objective of the present invention to provide the two separate and distinct sections in the nozzle-heads, with each section having its own connecting hose, whereby the first nozzle-section has a connecting hose coupled to a vacuum source, while the second nozzle-section has a connecting hose coupled to a supply of protective gas.

According to the invention, the first section of the nozzle-head is provided with an interiorly-located, elongated channel, or manifold, that fluidly connects a series of first nozzles, or orifices, the exit-ends of which are located at the tip of the nozzle-head, so that these orifices may be fluidly coupled to the interior of the packages for evacuating them via the vacuum source to which the orifices are connected. Interspersed between these first orifices are a few, second orifices, which also have their exit-mouths at the tip of the nozzle-head. The second orifices are spaced apart one from the other along the length of the nozzle-head, and are coupled to a second manifold that is positioned exteriorly of the housing of the nozzle-head. The second manifold is coupled to a supply of protective inert gas.

BRIEF DESCRIPTION OF THE DRAWINGS

The invention will be more readily understood with reference to the drawing, wherein.

DETAILED DESCRIPTION OF THE INVENTION

Figure 1:
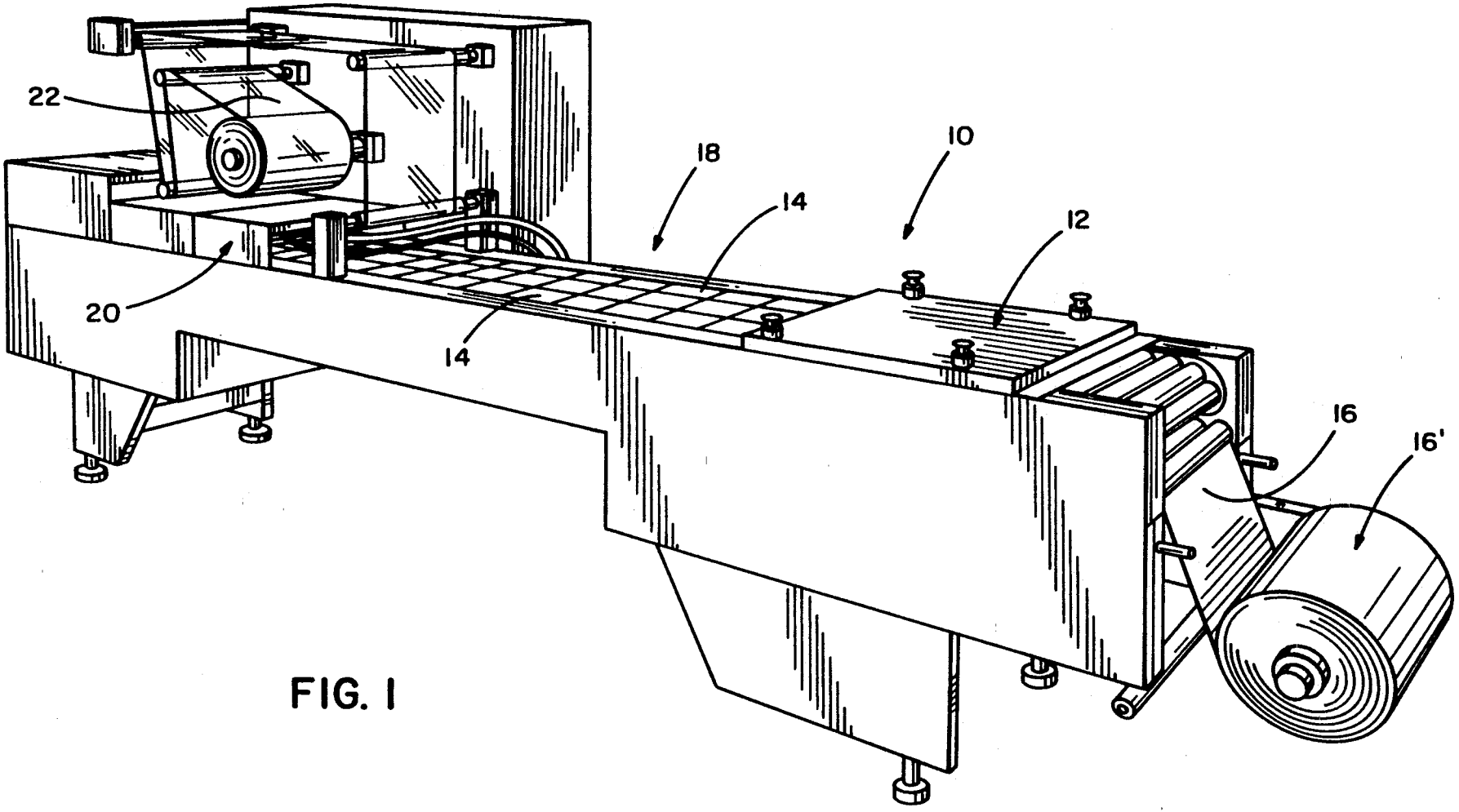
FIG. 1 is a perspective view of a vacuum-packaging machine the dual-section nozzle-head of the invention.
Figure 2:
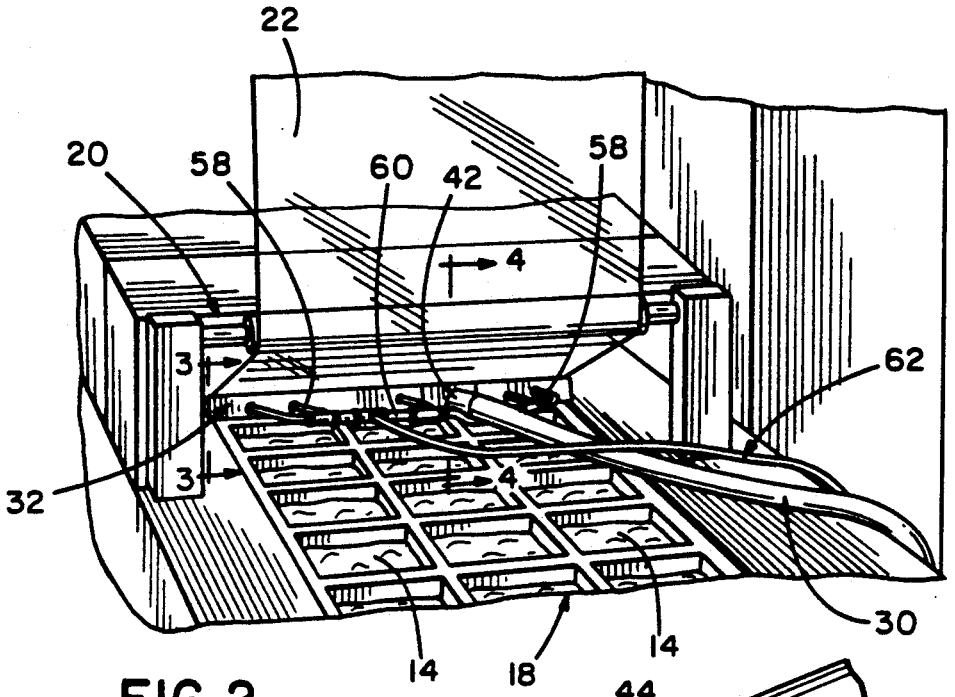
FIG. 2 is a detail view, in perspective, of the sealing station which incorporates the dual-section nozzle-head of the invention.
Figure 3:
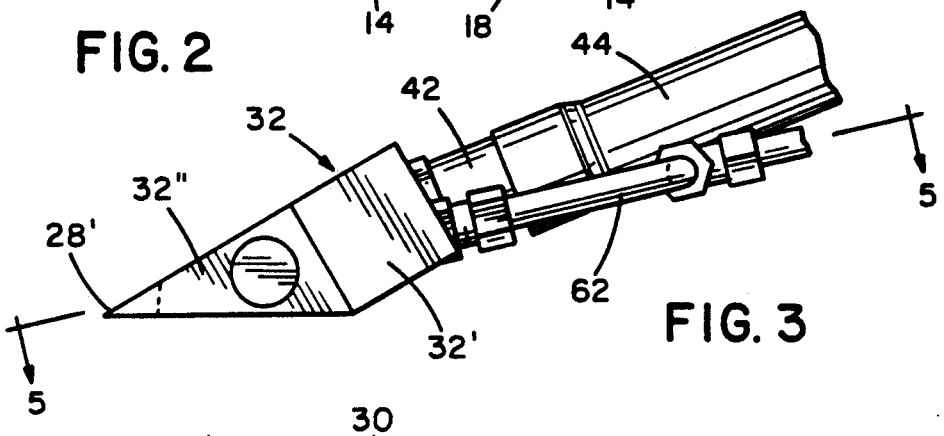
FIG. 3 is a view taken along line 3—3 of FIG. 2.
Figure 6:
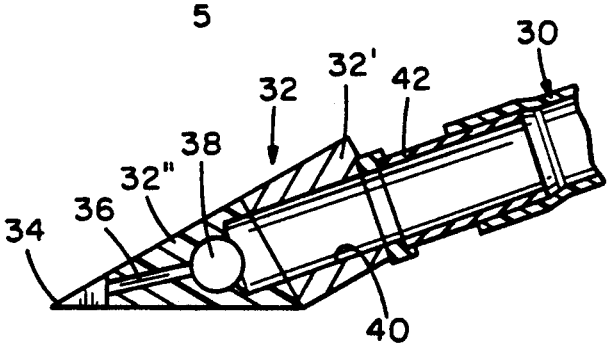
FIG. 6 is a cross-sectional view taken along line 6—6 of FIG. 5.
Figure 7:
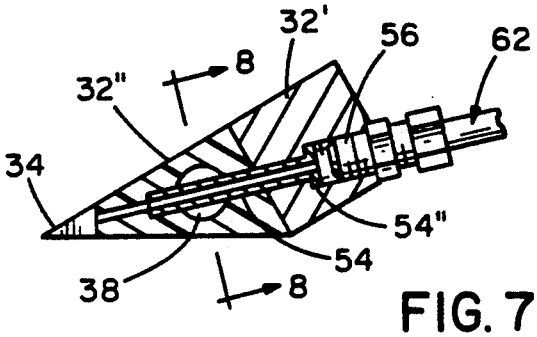
FIG. 7 is a cross-sectional view taken along line 7—7 of FIG. 5.
Figure 8:
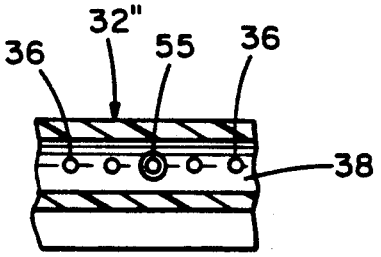
FIG. 8 is a cross-sectional view taken along line 8—8 of FIG. 7.
Figure 4:
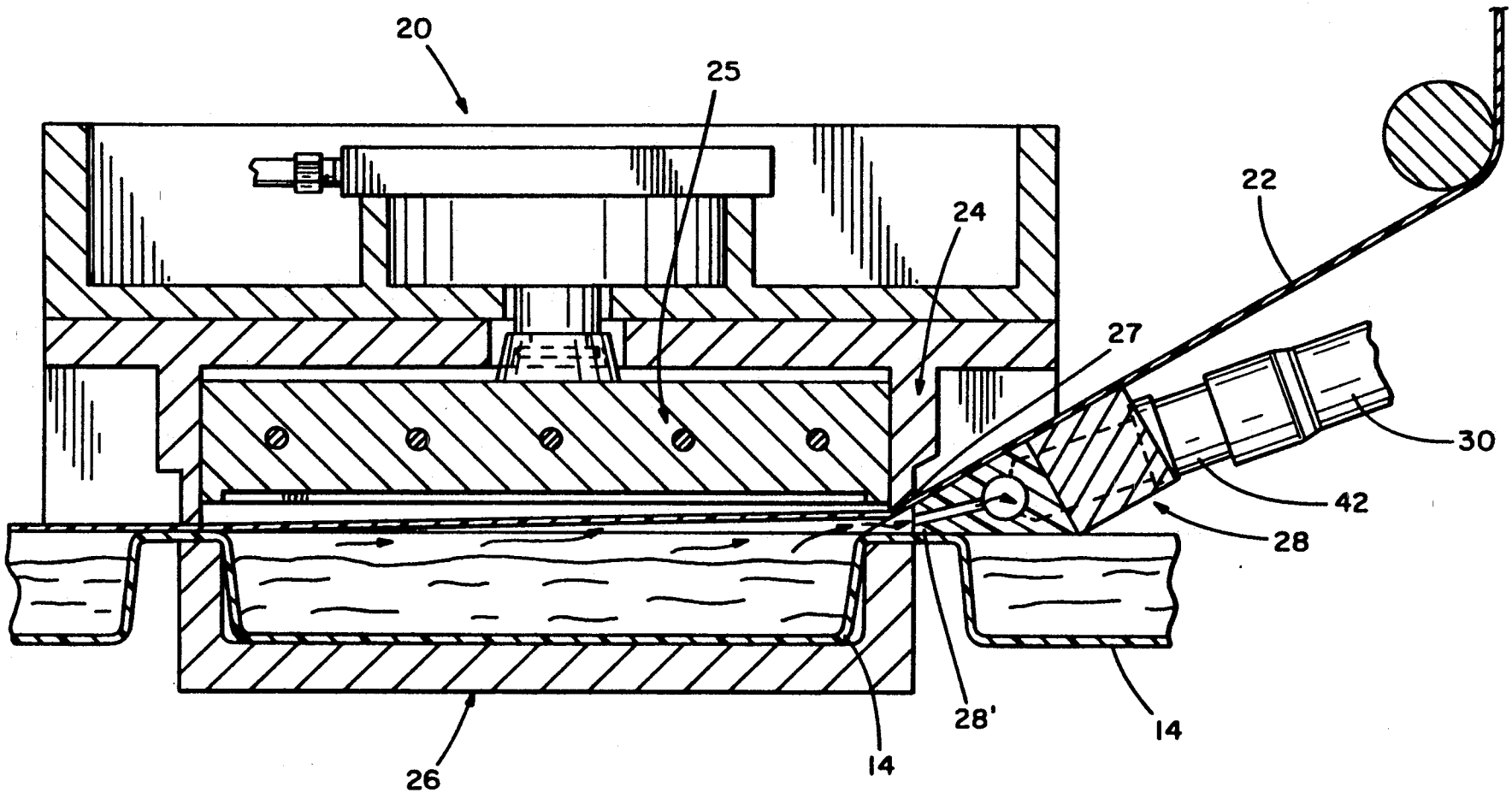
FIG. 4 is a cross-sectional view taken along line 4—4 of FIG. 2.
Figure 5:
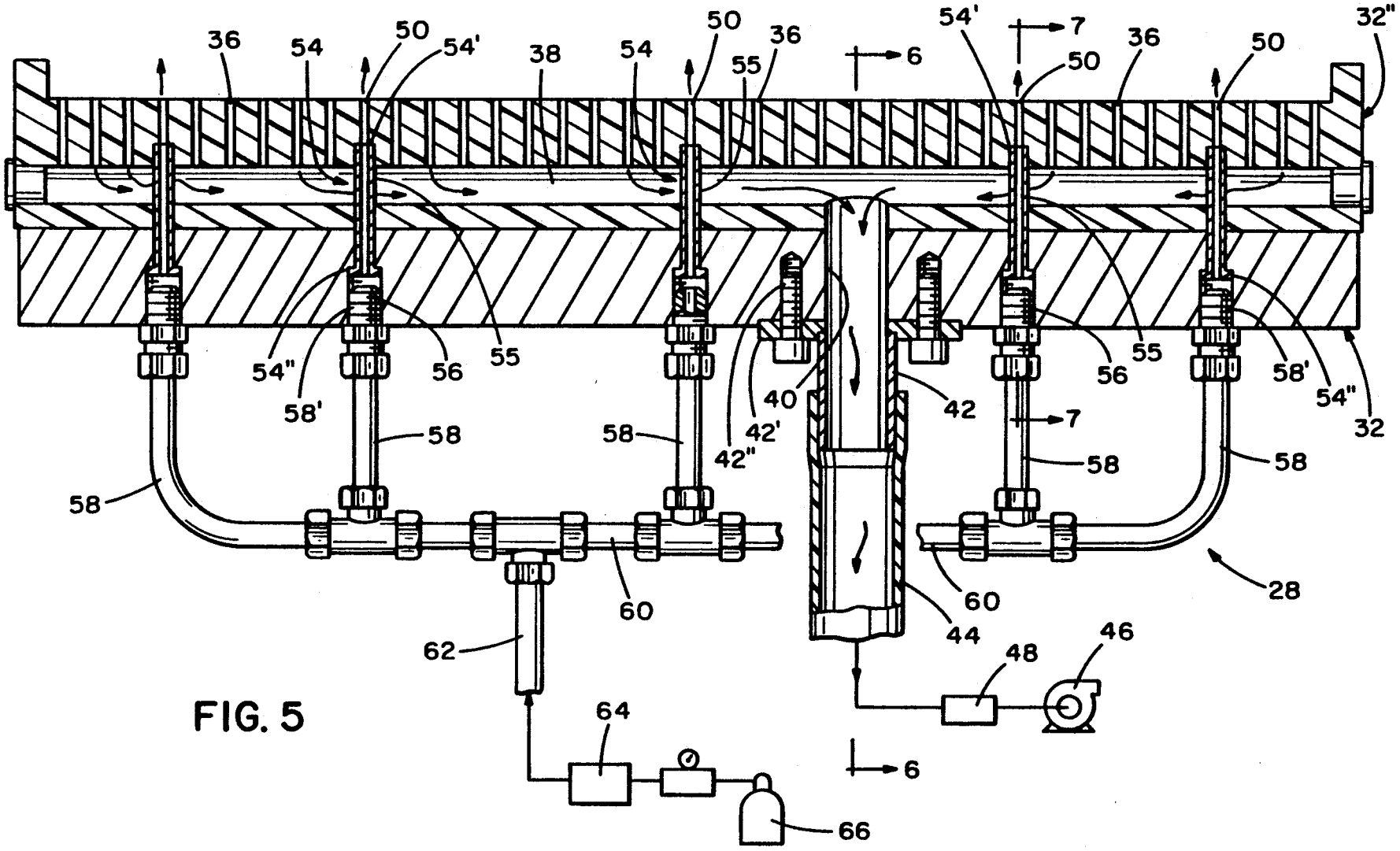
FIG. 5 is a cross-sectional view taken along line 5—5 of FIG. 3.

Referring now to the drawing in greater detail, a vacuum-packaging machine is indicated generally by reference numeral 10. The vacuum-packaging machine 10 shown in FIG. 1 is conventional, and may be a "TIROMAT" 3000 manufactured by Kramer and Grebe Engineering, except for the dual-nozzle head of the invention and its associated connections, as explained below in detail. The vacuum-packaging machine 10 includes a package-forming station 12, where a series of separate packages 14 are formed from a bottom film 16 supplied from a roll 16'. The film 16 is conveyed from the roll 16', through the package-forming station 12, to a product-insertion station 18, where the products are placed into the thus-formed packages 14, and, thence, to a sealing station 20, which sealing station 20 incorporates the dual-nozzle head system of the invention. At the sealing station 20, a top film-layer 22 is laid over the bottom, film-layer packages, or package-wells, 14, as best seen in FIG. 4. The top film-layer 22 is held by an upper, vertically-movable suction-tool 24, while the bottom film-layer with package-wells 14 is held by a lower, vertically movable suction tool 26. The two suction tools 24 and 26 have a length extending the full width of the machine and structurally retain the two films along the plurality of packages being simultaneously formed at the sealing station 20, so that the films do not collapse during the evacuation process. At the sealing station 20, the top and bottom film-layers are heat-sealed together about the edges of the packages 14 via a vertically-movable heat-sealing tool 25. The heat-sealing tool 25 is lowered to heat-seal the peripheral edge-surfaces of the lower package-wells 14 and upper closure film 22 after the packages have been evacuated and gas-infused, as discussed below. Before the two film-layers are completely sealed about the packages, the packages are evacuated via the nozzle-head 28. The nozzle-head 28 has a length that extends the full packages being simultaneously formed at the sealing station 20, so that the nozzle-head simultaneously evacuates all of the packages. The nozzle-head 28 is positioned vertically between the upper and lower suction tools 24, 26, and upstream therefrom. The nozzle-head defines a tapered tip or end 28' best seen in FIGS. 3, 6 and 7, in order to be snugly received between the opposing, juxtapositioned suction tools 24, 26, respectively, as best seen in FIG. 4, whereby orifices in the nozzle-head communicate with the interior of the packages for creating a vacuum in them. The upper suction-tool 24 has a cutout section defining a sloping wall 27 in which the tapered end 28' of the nozzle-head 28 is received in order to form a completely sealed chamber at the sealing station. The nozzle-head 28 is coupled to a vacuum source for evacuating the packages.

Unlike the prior-art nozzle-heads, the nozzle-head 28 has two distinct, separate sections: A first section for evacuating the packages, and a second section for injecting protective gas into the packages after, or even during, evacuation and immediately before the final sealing of the package. The nozzle-head 28 of the invention is best seen in FIGS. 3–8. The nozzle-head 28 has a main housing 32 that defines a rear, rectangular section 32' made of metal, and a tapered, forward section 32" made of plastic, which section 32" ends in a relatively narrow tip-end 34 for insertion between the top and bottom suction-tools 24, 26, as described above, for creating a vacuum in the packages at the sealing station. As can best be seen in FIG. 5, the nozzle-head 32 is elongated, such that is has a length extending the full width of the sealing station, in order to simultaneously evacuate a plurality of packages being sealed at the sealing station. The tapered forward section 32" is provided with a series of first orifices, or nozzle-conduits, 36 through which the packages at the sealing station are evacuated. Each orifice 32" has an outlet end that communicates with the exterior of the nozzle-head, and an inner end that communicates with an elongated manifold 38. The manifold 38 is, in turn, in fluid communication with a central, main, suction conduit-line 40 formed in the rear, rectangular section 32, The conduit-line 40 communicates with a first suction-hose 42 that is coupled to a secondary hose-line 44, which is connected to a vacuum-source 46 via a valve 48. The hose 42 is secured to the rear, rectangular section 32, via a mounting flange 42, and screws 42". Actuation of the vacuum source 46 will, therefore, evacuate all of the packages at the sealing station.

The tapered, forward section 32" of the main housing of the nozzle-head 28 includes a plurality of second orifices, or nozzle-conduits, 50, which are substantially identical to the orifices 36, except that each orifice 50 has associated therewith a tubular feed-line. The feed-line supplies protective gas to the orifices 50, by which the gas is injected into the packages at the sealing station just before the final sealing operation of each package. Each feed-line 52 includes a tube 54 having a diameter greater that the diameter of each orifice 50. Each tube 54 has an outer end-portion 54' embedded in a rear cutout portion of the tapered forward section 32", an intermediate, linear section 55 passing through the first manifold 38 and through passageways formed in the rear, or interior, section of the tapered forward section 32" and in the forward end of the rear, rectangular section 32', and an enlarged inner, or interior, end portion 54". The enlarged, inner end portion 54" protrudes into an interiorly-threaded opening 56 that receives a threaded end 58' of an exterior feed-conduit 58. All of the feed-conduits communicate with an exterior manifold 60, that is coupled to a supply line 62 connected a valve 64 of a supply 66 of protective gas. There are five such orifices 50 shown in the FIG. 5, spaced along the length of the nozzle-head 28. Of course, the number and placement of the orifices 50 may vary, as long as at least one orifice 50 is associated with each package being evacuated and sealed at the sealing station.

Figure 9:
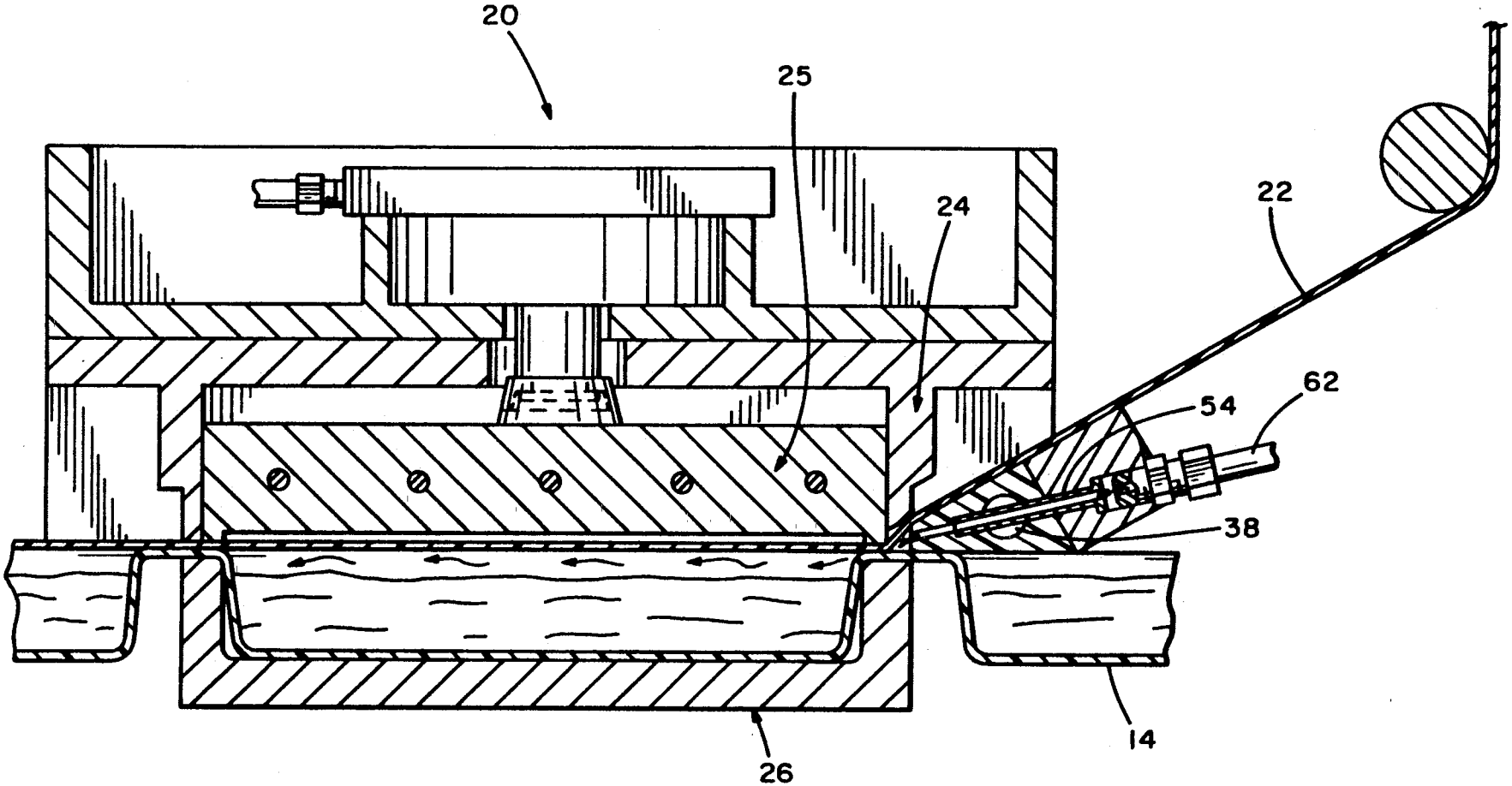
FIG. 9 is a view similar to FIG. 4, but showing the sealing station and nozzle-head after the package has been sealed at the sealing station.

In use, the orifices 36 are first used to evacuate the packages before the final sealing thereof, via the vacuum source 46 and hose lines 44, 42 and manifold 38. During the evacuation process, some food particles will be sucked out from the packages into the orifices 36, manifold 38, and hose-lines 44, 46. However, since these passageways are used only for evacuation, the sucked-out food particles, which will decay and become bacteria-laden, cannot re-enter the packages, since these passageways are not used for injecting the protective gas. Injection of the gas is performed just prior to the sealing of the packages via the heat-sealing tool 25, which sealing is seen in FIG. 9, and is achieved, through the main line 62, manifold 60, feed-lines 58 and 54, and orifices 50, all of which are completely, fluidly isolated from the vacuum-lines. Selective operation of the valves 48 and 64 in a conventional manner will couple the vacuum-system for evacuating the packages, or will couple the protective gas supply-source for injecting the gas into the packages during gas-infusion. When evacuation is being performed, the valve 48 supply-source for injecting the gas into the packages during gas-infusion. When evacuation is being performed, the valve 48 is open, and the valve 64 is usually closed. When gas-infusion is being performed, the valve 64 is open and the valve 48 is usually closed. Of course, control of the valves 48 and 64 is preferably performed automatically by the controls of the machine 10 during the package-formation at the sealing station, as in currently done in conventional vacuum-packaging machines.

The prior-art nozzle-heads, of necessity, had to first evacuate the packages at the sealing station, and only then was the gas-infusion process initiated. That is, the time intervals for the evacuation process and the gas-infusion process could not overlap; gas infusion could only be started after the termination of the evacuation process. According to the nozzle of the present invention, since there are two, distinct, sealed sections, one for the evacuation process and one for the gas-infusion process, such time-interval restriction does not hold. Thus, it is possible to start the gas-infusion process even while the evacuation process is still being performed. This has the great advantage of injecting the protective gas, such as nitrogen, into the packages while they are still being evacuated, which nitrogen will, to a limited degree, react with free the oxygen molecules still remaining in the packages. Thus, the combined, reactive nitrogen/oxygen will be pumped away by the vacuum-orifices 36. This achieves even greater evacuation of oxygen from the packages, which will extend the shelf-life of the packages. This concept is also applicable to any environment where it is desired to remove as much oxygen as possible from a closed chamber, or the like. The nozzle-head 28, therefore, has uses in other environments, where it is desired to evacuate as much oxygen as possible.

While a specific embodiment of the invention has been shown and described, it is to be understood that numerous changes and modifications may be made therein without departing from the scope, spirit and intent of the invention as set forth in the appended claims.

What we claim is:

1. In a vacuum-packaging machine comprising a sealing station, and a nozzle-head comprising a main housing operatively associated at said sealing station for evacuating packages being sealed at said sealing station and for injecting protective gas into the packages being sealed at said sealing station, said main housing having a first, rearward, section and a second, forward, tapered section, said tapered section terminating in a narrower end and comprising a plurality of orifices used during the evacuation of packages at said sealing station, each of said orifices having an exterior-end at said narrower end and an interior end in said main housing; said main section further comprising a common manifold for said interior ends of said orifices; said nozzle-head further comprising inlet-conduit means in fluid communication with said common manifold, and a vacuum-source means coupled to said inlet-conduit means for providing a vacuum; the improvement comprising:

said nozzle-head comprising a plurality of additional orifices each having an exterior-end at said narrower end and an interior end in said main housing for injecting protective gas into the packages at said sealing station;

a plurality of conduit-feed means for said plurality of additional orifices, one said conduit-feed means for one said additional orifice, each of said conduit-feed means comprising a first end in operative engagement with a respective said interior end of a respective said additional orifice, and a second end;

another common manifold in operative couplement with each said second end of each of said plurality of conduit feed means; and a protective-gas supply source means for supplying protective gas to said another common manifold, to said plurality of conduit-feed means, and to said additional orifices, whereby the protective gas is injected into packages being sealed at said sealing station via said plurality of additional orifices;

said orifices for said vacuum-source means, said inlet-conduit means and said common manifold being fluidly isolated from said plurality of additional orifices, from said plurality of conduit-feed means, and said another manifold, whereby, when the protective gas is injected into the packages, none of the food-particles sucked out during the evacuation of the packages is injected back into the packages during the injection of the protective gas.

2. The vacuum-packaging machine according to claim 1, Wherein said plurality of additional orifices are separated along the length of said tapered section; at least one of said additional orifices being separated from another said additional orifice by a plurality of said orifices for said vacuum-source means.

3. The vacuum-packaging machine according to claim wherein said plurality of additional orifices are separated along the length of said tapered section; each of said additional orifices being separated from another said additional orifice by a plurality of said orifices for said vacuum-source means.

4. The vacuum-packaging machine according to claim 1, wherein said additional manifold is positioned exteriorly of said first rearward section and said second forward section of said main housing.

5. The vacuum-packaging machine according to claim 1, wherein each of said plurality of conduit-feed means comprises an elongated tubular member having a first end in said second forward section of said main housing at a respective said interior end of a respective said additional orifice, said first end of said elongated tubular member constituting said first end of said conduit-feed means.

6. The vacuum-packaging machine according to claim 5, wherein each said elongated tubular member further comprises a second end positioned in said first rearward section at a portion thereof juxtapositioned opposite to the portion of said second section at which said first end of said tubular member is positioned; each of said plurality of conduit-feed means further comprising a connecting conduit having a first end operatively associated with a said second end of a respective said tubular member, and a second end projecting exteriorly through said first rearward section of said main section for connection to said another common manifold.

7. The vacuum-packaging machine according to claim 6, wherein each of said tubular members has an external dimension greater than that of said additional orifices; said second forward section having a plurality of cutouts for receiving therein said first ends of said tubular members, said first rearward section having a plurality of first, smaller passageways for passing therethrough said plurality of tubular members, and a plurality of second, larger passageways for passing therethrough portions of said connecting conduits.

8. The vacuum-packaging machine according to claim 7, wherein each said second end of each of said plurality of tubular members comprises an enlarged flange for positioning in a respective said second passageway for abutting engagement against a respective said first end of a respective said connecting conduit.

9. A dual-function nozzle-head for use in vacuum-packaging machines, comprising:

a main housing for use in evacuating packages being sealed at a sealing station of a vacuum-packaging machine, and for injecting protective gas into the packages being sealed at the sealing station, said main housing having a first, rearward, section and a second, forward section having an end, said second section comprising a plurality of first orifices used during the evacuation of packages at a sealing station, each of said first orifices having an exterior-end at said end of said second section and an interior end in said main housing;

nozzle-head further comprising a plurality of second orifices each having an exterior-end at said end of said second section and an interior end in said main housing for injecting protective gas into the packages at said sealing station;

vacuum-source means coupled to first orifices for providing a vacuum;

protective-gas supply source means for supplying protective gas to said plurality of second orifices, whereby protective gas may be injected into packages being sealed at a sealing station;

said first orifices and said vacuum-source means being fluidly isolated from said plurality of second orifices and said protective-gas supply source means, so that none of the food-particles sucked out during the evacuation of packages is injected back into the packages during the injection of the protective gas.

10. The dual-function nozzle-head for use in vacuum-packaging machines according to claim 9, wherein said vacuum-source means comprises a first common manifold in said main section in fluid connection with said interior ends of said first orifices, inlet-conduit means formed in said main housing and in fluid communication with said common manifold, and a vacuum-source coupled to said inlet-conduit means for providing a vacuum.

11. The dual-function nozzle-head for use in vacuum-packaging machines according to claim 10, wherein protective-gas supply means comprises a plurality of conduit-feed means mounted in said main housing for said plurality of second orifices, one said conduit-feed means for one said second orifice, each of said conduit-feed means comprising a first end in operative engagement with a respective said interior end of a respective said additional orifice, and a second end;

and a second common manifold in operative couplement with each said second end of each of said plurality of conduit feed-means.

12. The vacuum-packaging machine according to claim 11, Wherein said second common manifold is positioned exteriorly of said first rearward section and said second forward section of said main housing.

13. The dual-function nozzle-head for use in vacuum-packaging machines according to claim 12, wherein each of said plurality of conduit-feed means comprises an elongated tubular member having a first end in said second forward section of said main housing at a respective said interior end of a respective said second orifice, said first end of said elongated tubular member constituting said first end of said conduit-feed means, each said elongated tubular member further comprising a second end positioned in said first rearward section at a portion thereof juxtapositioned opposite to the portion of said second section at which said first end of said tubular member is positioned; each of said plurality of conduit-feed means further comprising a connecting conduit having a first end operatively associated with a said second end of a respective said tubular member, and a second end projecting exteriorly through said first rearward section of said main section for connection to said second common manifold.

14. The dual-function nozzle-head for use in vacuum-packaging machines according to claim 13, wherein each of said tubular members has an external dimension greater than that of said second orifices; said second forward section having a plurality of cutouts for receiving therein said first ends of said tubular members, said first rearward section having a plurality of first, smaller passageways for passing therethrough said plurality of tubular members, and a plurality of second, larger passageways for passing therethrough portions of said connecting conduits.

15. The dual-function nozzle-head for use in vacuum-packaging machines according to claim 14, wherein each said second end of each of said plurality of tubular members comprises an enlarged flange for positioning in a respective said second passageway for abutting engagement against a respective said first end of a respective said connecting conduit.

16. A dual-function nozzle-head for use in vacuum-packaging machines, comprising:

a main housing for use in evacuating packages being sealed at a sealing station of a vacuum-packaging machine, and for injecting protective gas into the packages being sealed at the sealing station;

said main housing having a first section for use in evacuating packages at a sealing station, and a second section for injecting protective gas into the packages;

said first section being fluidly, sealingly isolated from said second section, so that none of the food-particles sucked out during the evacuation of packages is injected back into the packages during the injection of the protective gas.

17. The dual-function nozzle-head for use in vacuum-packaging machines according to claim 16, wherein said first section comprises a plurality of first orifices used during the evacuation of packages at a sealing station, each of said orifices having an exterior-end communicating exteriorly of said main housing, and an interior end in said main housing; said second section comprising a plurality of second orifices each having an exterior-end communicating exteriorly of said main housing and an interior end in said main housing for injecting protective gas into packages.

18. The dual-function nozzle-head for use in vacuum-packaging machines according to claim 17, wherein the number of said first orifices are much greater than the number of said second orifices; each said second orifice being spaced from another, adjacent said second orifice by a plurality of said first orifices.

19. A method of evacuating packages at a sealing station of a vacuum-packaging machine and for injecting protective gas into the same packages, comprising:

(a) evacuating packages at a sealing station of a vacuum-packaging machine through a plurality of first orifices of a nozzle-head;

(b) injecting protective gas into the packages through a plurality of second orifices that are fluidly isolated from the first orifices.

20. The method according to claim 19, wherein step (b) is at least partially performed during step (a).

21. The method according to claim 19, wherein step (b) is partially performed at the end of said step (a), and after the termination of said (a).

22. A method of evacuating a closed chamber of oxygen, comprising:

(a) evacuating the chamber through a first orifice means; and (b) injecting a gas that reacts with oxygen into the chamber through a second orifice means that are fluidly isolated from the first orifice means;

(c) said step (b) commencing before said step (a) is terminated;

said step (a) evacuating the chamber of the injected gas and oxygen when said steps (a) and (b) are concurrently carried out.

* * * * *